US005444993A

United States Patent [19]

Yamamoto et al.

[11] Patent Number: 5,444,993

[45] Date of Patent: Aug. 29, 1995

[54] CONDENSER FOR REFRIGERATING CYCLE

[75] Inventors: Ken Yamamoto, Oobu; Isao Kuroyanagi, Anjo; Yasushi Yamanaka, Nakashima; Nobuharu Kakehashi, Anjo, all of Japan

[73] Assignee: Nippondenso Co., Ltd., Kariya, Japan

[21] Appl. No.: 247,971

[22] Filed: May 23, 1994

[30] Foreign Application Priority Data

May 24, 1993 [JP] Japan ..... 5-121462
Apr. 11, 1994 [JP] Japan ..... 6-072059

[51] Int. Cl.[6] ..... F25B 39/04

[52] U.S. Cl. ..... 62/473; 62/507; 62/196.4

[58] Field of Search ..... 62/470, 473, 506, 507, 62/84, 117, 196.4

[56] References Cited

U.S. PATENT DOCUMENTS

| | | | |
|---|---|---|---|
| 2,921,448 | 1/1960 | Carraway | 62/473 X |
| 3,430,453 | 3/1969 | Norton | 62/507 X |
| 3,440,833 | 4/1969 | Fernandes | 62/507 X |
| 3,481,152 | 12/1969 | Seeley | 62/506 X |
| 5,146,767 | 9/1992 | Kadle et al. | 62/507 X |

OTHER PUBLICATIONS

"Text for an Advanced Refrigerating Technology", pp. 206–213, 1990.

*Primary Examiner*—Harry B. Tanner
*Attorney, Agent, or Firm*—Cushman Darby & Cushman

[57] ABSTRACT

A condenser for a refrigerant, capable of varying the condensing capacity of the condenser in accordance with a load, so that a condensing pressure larger than a predetermined value is maintained at the condenser when the load is low. The condenser includes a inlet header 15 to which a first inlet conduit 17 is connected at its top location. The inlet conduit 17 is provided with a U-shaped portion 17*a* and an upright portion 17*b*. A second inlet conduit 18 is connected to the header 15 at its bottom location. During a high load condition, the high speed of the flow of the refrigerant prevents a lubricant mixed with the refrigerant from being held at the U-shaped portion 17*a*, so that the gaseous state the refrigerant can pass through the upright portion 17*b*, so that the refrigerant is introduced into all of heat exchanging tubes 13, thereby obtaining a large area of the heat emission by the heat exchanging tubes 13. During a low load condition, the low speed of the flow of the refrigerant allows the lubricant to be held at the U-shaped portion 17*a*, so that the gaseous state the refrigerant is blocked at the first inlet conduit 17, so that the refrigerant is introduced only into the heat exchanging tubes connected to the second inlet conduit 18, thereby providing a small area for the heat emission by the heat exchanging tubes 13.

7 Claims, 7 Drawing Sheets

CONDENSER FOR REFRIGERATING CYCLE

BACKGROUND OF THE INVENTION

1. Field of the Invention

The present invention relates to a condenser for condensing a gaseous refrigerant by cooling it, and is suitably used in a refrigerating circuit for an air conditioning system for an automobile.

2. Description of Related Art

While heating a cabin of an automobile, recent air pollution legislation makes it usual to use an inner recirculation mode, where the air in the cabin is recirculated. Heating by an inner air recirculation mode, however, may cause windows (wind shield, rear window and side windows) to be fogged. In order to prevent the windows from being fogged, an air conditioning system is, even in the winter season, operated in a dehumidifying mode so that the air in the cabin is dehumidified.

However, operation of the refrigerating system during the winter season causes the condensing pressure as well as the evaporating pressure to be reduced since the load is very small. A reduction in the pressure of the refrigerant also reduces the temperature. Namely, the temperature of the refrigerant at the evaporator can fall below 0° C., which causes the evaporator to frost up. In order to prevent the evaporator from frosting up, the usual solution is to stop the compressor in the refrigerating cycle when the evaporating pressure is reduced to a predetermined value. In place of the selective stopping of the compressor, Japanese Un-Examined Patent Publication No. 63-302257 discloses a refrigerating circuit including a evaporating pressure regulator for controlling the flow amount of the refrigerant in accordance with the pressure at the evaporator for preventing the stopping of the compressor while maintaining a desired pressure in the refrigerant.

However, such a control of the evaporating pressure causes the pressure difference of the evaporator with respect to the condenser to be also reduced, which causes the amount of the refrigerant passing through an expansion valve, which is arranged between the condenser and the evaporator to be reduced. Such a reduction of the amount of the refrigerant passing through the expansion valve causes the dehumidifying capacity to be reduced at the evaporator. As a result, the effect of clearing the fog on the windows becomes insufficient.

SUMMARY OF THE INVENTION

An object of the present invention is to provide an improved construction of an evaporator, capable of overcoming the above mentioned drawbacks in the prior art.

According to the present invention, a condenser is disclosed for constructing, together with a compressor, a pressure reducing means and an evaporator, a refrigerating cycle, said condenser comprising:

a plurality of vertically spaced heat exchanging tubes in which a refrigerant in the refrigerating cycle flows, while an outer flow of a heat exchanging medium contacts the heat exchanging tubes, so that a heat exchange occurs between the refrigerant in the heat exchanging tubes and the heat exchanging medium, causing the heat to be emitted from the outside of heat exchanging tubes;

an inlet for the gaseous state refrigerant from the compressor into the heat exchanging tubes;

an outlet for the condensed refrigerant from the heat exchanging tubes;

the heat exchanging pipes being grouped into at leat two sets, the heat exchanging pipes in the first set defining a first heat exchanging passageway for the refrigerant, the heat exchanging pipes in said second set defining a second heat exchanging passageway for the refrigerant, the flows of the refrigerant in the first and second passageways being separate from each other;

a first inlet passageway for connecting said inlet with the first heat exchanging passageway in the first set of the heat exchanging pipes for introducing a part of the introduced gaseous refrigerant into the first heat exchanging passageway;

a second inlet passageway for connecting said inlet with the second heat exchanging passageway in the second set of the heat exchanging pipes for introducing the remaining part of the introduced gaseous refrigerant into the second heat exchanging passageway;

said first inlet passageway forming, at a location along the flow of the refrigerant, a portion for causing a lubricant mixed with the refrigerant to stay at the portion;

said portion being such that the lubricant held at the portion closes the first inlet passageway to block the flow of the refrigerant in the first inlet passageway when the amount of the flow of the refrigerant is smaller than a predetermined value, thereby introducing the refrigerant from the compressor only into the first heat exchanging passageway.

According to the present invention, during a high load condition, the speed of the refrigerant as introduced is high, so that the mixed lubricant is not held at the portion, which allows the gaseous refrigerant to move in the second inlet passageway. As a result, the gaseous refrigerant is introduced not only into the first set of the heat exchanging pipes via the first passageway but also into the second set of the heat exchanging pipes via the second passageway. As a result, all of the heat exchanging tubes can serve the heat exchanging function, thereby obtaining an increased or maximum condensing ability. During a low load condition, the speed of the refrigerant as introduced is low, so that the mixed lubricant is held at the portion, which prevents the gaseous refrigerant from moving in the second inlet passageway. As a result, the gaseous refrigerant is introduced only into the first set of the heat exchanging pipes via the first passageway. As a result, only a part of the heat exchanging tubes can serve the heat exchanging function, thereby obtaining a reduced condensing ability. Due to such a reduction of the condensing ability, an increase in the temperature of the refrigerant, i.e., an increase in the pressure of the refrigerant, at the condenser is obtained.

According to the present invention, an increase in the condensing pressure is obtained during the low load condition by reducing the heat emission area at the condenser. As a result, a pressure difference larger than a predetermined value is obtained between the condensing pressure and the evaporating pressure, i.e., between the inlet and the outlet of the pressure reducing means (expansion valve). As a result, an increased amount of the refrigerant flowing throughout the pressure reducing means, i.e., the amount of the refrigerant introduced into the evaporator is obtained. Thus, a desired evaporating capacity is obtained at the evaporator.

BRIEF EXPLANATION OF ATTACHED DRAWINGS

DESCRIPTION OF PREFERRED EMBODIMENTS

Figure 1:
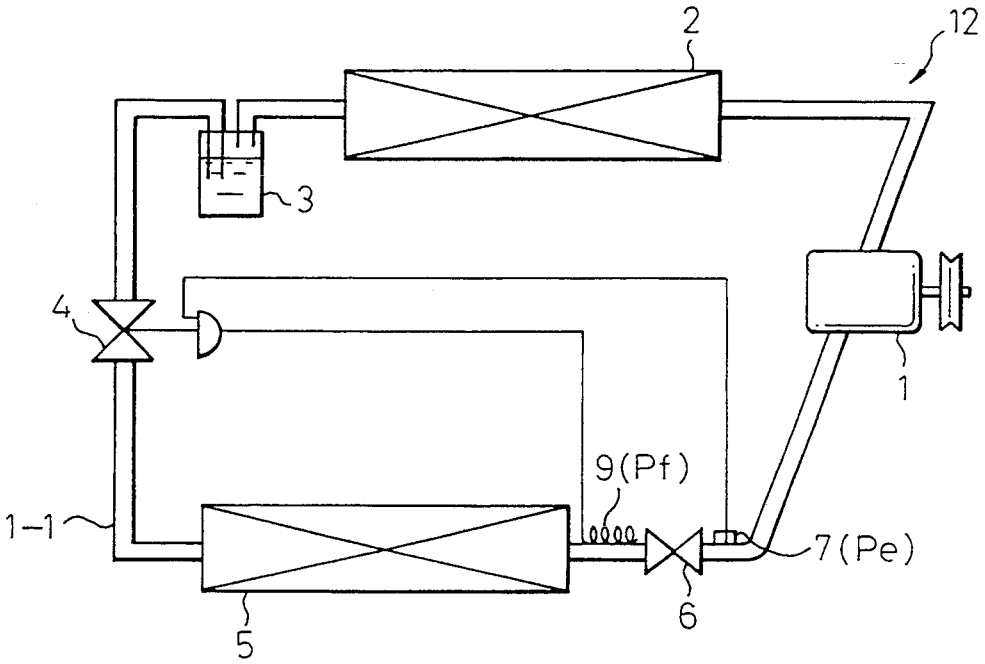
FIG. 1 is a schematic view of a refrigerating circuit according to the present invention.
Figure 2:
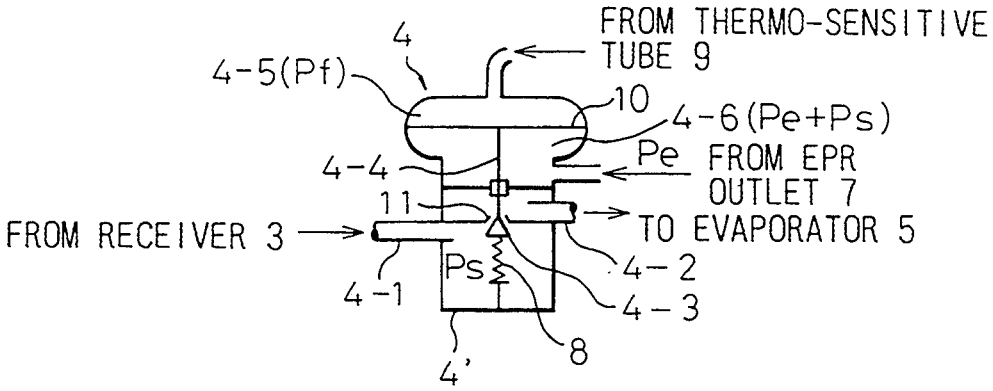
FIG. 2 is a detailed view of an expansion valve in FIG. 1.

FIG. 1 generally illustrates a refrigerating circuit for an air conditioning device for an automobile, which includes a compressor 1, a condenser 2, a receiver 3, an expansion valve 4 and an evaporator 5 which is arranged in series along a refrigerant recirculating passageway 1-1. As shown in FIG. 2, the expansion valve 4 includes a housing 4' having an inlet 4-1 connected to the receiver 3 and an outlet 4-2 connected to the evaporator 5, a valve member 4-3 for controlling a degree of an opening of an orifice 11, a diaphragm 10 connected to the valve member 4-2 via a rod 4-4, and a spring 8 urging the valve member 4-2 to close the orifice 11. A chamber 4-5 is created on one side of the diaphragm 10, which is connected to a thermo-sensitive tube 9 arranged at the outlet of the evaporator 5 as shown in FIG. 1. A high temperature of the gas at the thermo-sensitive tube 9 causes the diaphragm 10 in FIG. 2 to be downwardly moved, causing the degree of the throttle at the orifice 11 to be increased, thereby reducing the temperature of the gas at the thermo-sensitive tube 9.

The refrigerating circuit is, when the atmospheric air temperature is low, such as in a winter, operated for obtaining a dehumidifying operation, so that the cooling ability at the evaporator 5 can be utilized for obtaining a dehumidifying operation. However, the operation of the refrigerating circuit under a low conditioning load in a low atmospheric air temperature such as in winter results in a reduction of the condensing pressure at the condenser 2 as well as a reduction of the evaporating pressure at the evaporator 5. This can causes the temperature of the refrigerant to become lower than 0° C. at the outlet of the evaporator 5 as will be easily understood from a Mollier chart in FIG. 3. The temperature of the refrigerant lower than 0° C. causes the evaporator 5 to be frosted up. In order to prevent the refrigerant temperature becoming lower than 0° C., a conventional technique is that a controller of the refrigerating cycle is constructed such that the compressor 1 is stopped when the refrigerant pressure, which is proportional to the refrigerant temperature, becomes smaller than a predetermined value of 2 kgf/cm$^2$, corresponding to the refrigerant temperature at the evaporator 5 of 0° C. As a result of the stoppage of the compressor, frost is not created at the evaporator 5. In short, an operation and a stoppage are repeated at the compressor 1, which allows the air conditioning device to be operated for obtaining a dehumidifying function, even when the atmospheric air temperature is low, i.e., in the winter season.

Figure 3:
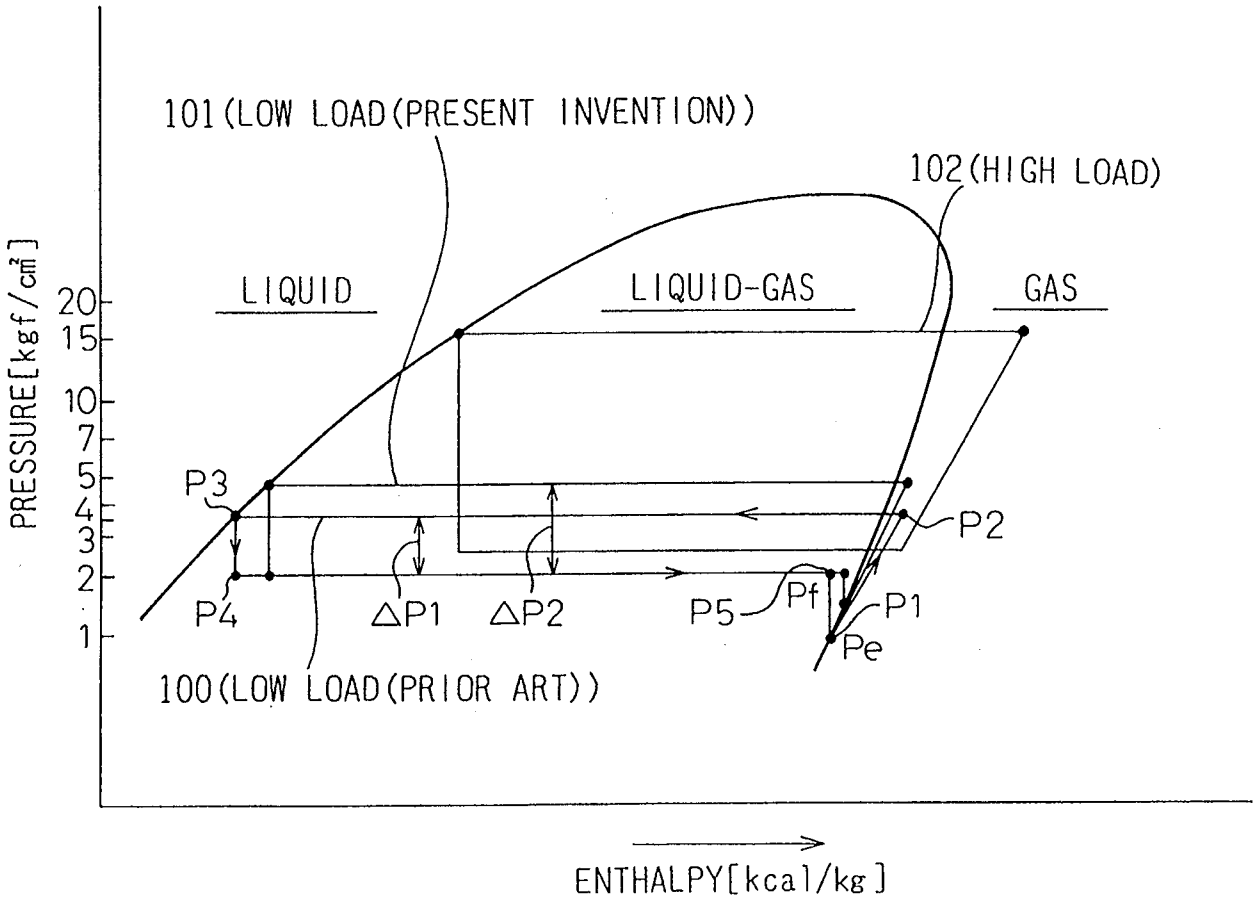
FIG. 3 is a Moiller chart illustrating an operation of the present invention in comparison with that of the prior art.

In place of the on-off type control of the compressor, a solution for obtaining a continuous operation of the compressor while preventing the evaporator from being frosted, which is, itself, disclosed in the Japanese Un-Examined Patent Publication No. 63-302257, is also employed in the present invention. Namely, a provision is made of an evaporating pressure regulator (EPR) 6 on the refrigerant passageway 1-1 downstream from the evaporator 5 and upstream from the compressor 1. The EPR 6 functions to control the amount of the refrigerant directed to the compressor 1 in order to obtain a predetermined fixed value of the pressure of the evaporated vapor of the refrigerant in the evaporator 5. As a result, the compressor 1 can be continuously operated, so that the compressor 1 is prevented from repetitively changing from an operated condition to a stopped condition. Namely, a reduction in the air conditioning load causes the EPR 6 to reduce the amount of the refrigerant flowing from the evaporator 5 to the compressor 1, thereby preventing the pressure of the evaporated refrigerant at the evaporator 5 from being reduced. In FIG. 3, a line 100 shows a relationship between the enthalpy and the pressure in the system when the EPR 6 is provided.

In the refrigerating circuit provided with the EPR 6, the outlet 7 of the EPR 6 is connected to a lower chamber 4-6 formed on a side of the diaphragm 10 remote from the upper chamber 4-5. In this case, the pressure at the upper chamber 4-5 is equal to the pressure $P_f$ of the gas in the thermo-sensitive tube 9, while the pressure at the lower chamber 4-6 is equal to pressure $P_e$ at the outlet 7 of the EPR 6 plus a force $P_s$ of the spring 8. Thus, the movement of the diaphragm, i.e., the degree of the throttle of the pressure reduction orifice 11 of the expansion valve 4 is controlled in accordance with the difference of the pressure between the upper and lower cheers 4-5 and 4-4, which is proportional to $P_f-(P_e+P_s)$.

In FIG. 3, a line 100 shows an operating diagram of the refrigerating cycle upon a low air conditioning load in the prior art. Namely, between a point $p_1$ and a point $p_2$, a compression by the compressor 1 is done, so that the pressure of the gaseous refrigerant is increased. Between point $p_2$ and point $p_3$, a condensation by the condenser 2 is done, so that the refrigerant is condensed to the liquid state while the pressure is maintained. Between point $P_3$ and $P_4$, a pressure reduction is done at the expansion valve 4, where the pressure of the liquid state refrigerant is reduced. Between points $P_4$ and $P_5$, an evaporating is done at the evaporator 5, so that the refrigerant is evaporated into the gaseous state, while the pressure is maintained. Upon a low air conditioning load in the refrigerating cycle provided with the EPR 6, as shown by the line 100 in FIG. 3, the pressure at the condenser 2 is lowered, and the pressure at the evaporator 3 is, basically, also lowered. However, as already explained, the EPR 6 functions to control the evaporating pressure to be larger than the predetermined fixed value. As a result, a pressure difference is created between the inlet and outlet of the EPR 6, i.e., between the points $P_5$ and $P_1$. Namely, the pressure $P_f$ of the refrigerant gas in the thermo-sensitive tube 9 at the outlet of the evaporator 5 is larger than the pressure $P_e$ of the refrigerant gas at the outlet 7 of the EPR. When the difference between the pressure $P_f$ of the refrigerant gas in the thermo-sensitive tube 9 and the pressure $P_e$ of the refrigerant gas at the outlet 7 of the EPR 6 is larger than the set force $P_s$ of the spring 8, the diaphragm 10 in FIG. 1 is moved downwardly against the force of the spring 8, so that the throttle of the orifice 11 of the expansion valve 4 is changed to a full open position, thereby increasing the amount of the refrigerant introduced into the evaporator 5 from the expansion valve 4.

In the refrigerating circuit provided with the EPR 6, in the low air conditioning load condition, the condensing pressure at the condenser 2, i.e., the distance between the points $p_2$ and $p_3$, is also lowered. As a result, a difference $\Delta P_1$ of the condensing pressure with respect to the evaporating pressure higher than the predetermined value at the evaporator 5 is also reduced, resulting in a reduction of the amount of the refrigerant passing through the expansion valve 4 even in a fully opened condition of the latter, i.e., when the valve member 4-3 is displaced against the force of the spring 8 to fully open the orifice 11. Such a reduction in the flow amount of the refrigerant causes the dehumidifying performance at the evaporator 5 to be reduced, so that it becomes difficult to prevent the vehicle windows from being fogged. The present invention aims to provide an improved construction capable of obtaining a varied condensing ability, while maintaining a condensing pressure in the condenser 2 larger than the predetermined value during a low road condition.

Figure 4:
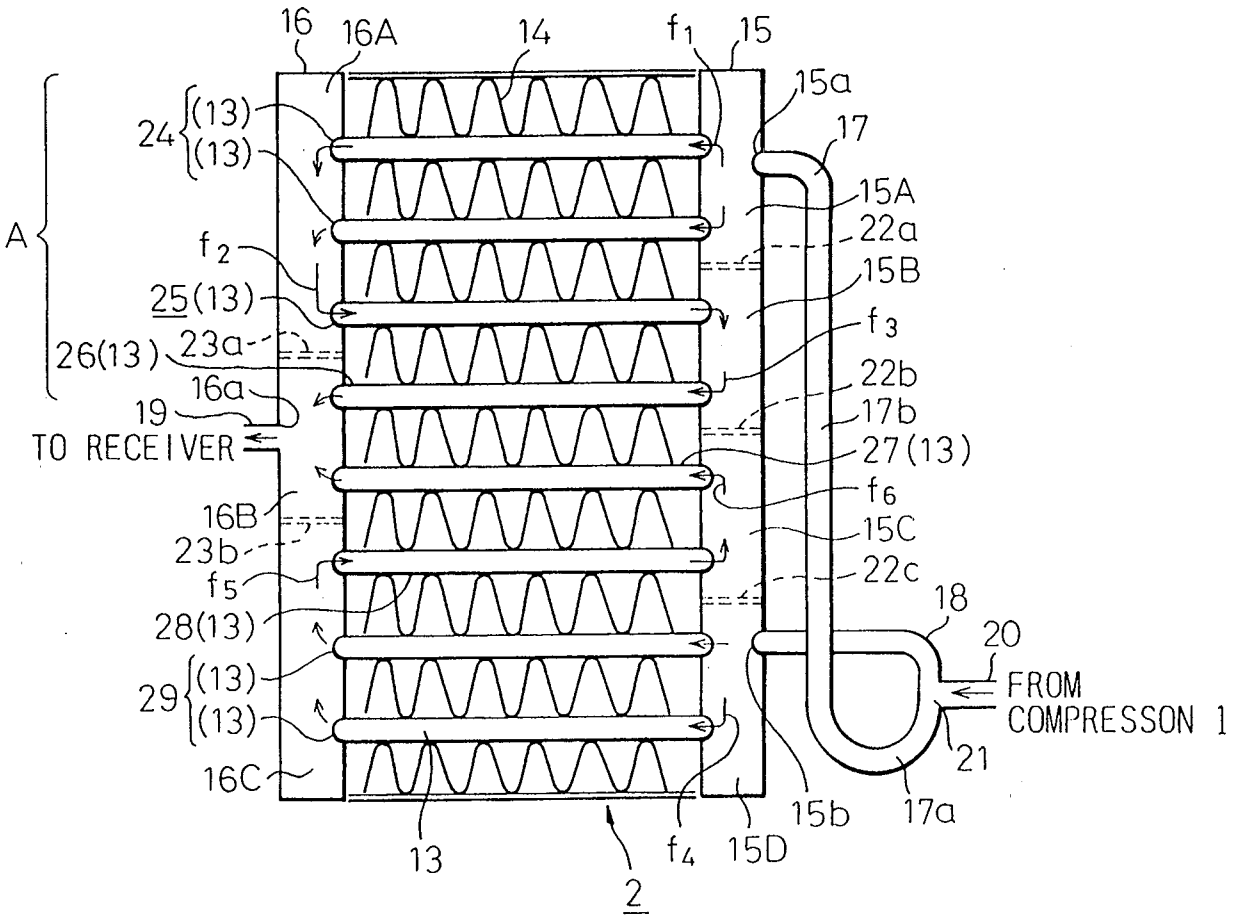
FIG. 4 is a schematic elevational view of a condenser according to the present invention.

Now, a detailed construction of the condenser 2 will be explained with reference to FIG. 4. In FIG. 4, the condenser 2 includes a heat exchanging part which is constructed by a plurality of heat exchanging tubes 13 which are spaced in parallel, corrugated fins 14 arranged between the heat exchanging tubes 13 and a pair of spaced headers 15 and 16, to which the heat exchanging tubes 13 are connected at their spaced ends, respectively.

Each of the tubes 13 is formed as a flattened tube, which includes therein a plurality of passageways for the refrigerant. The corrugated fins 14 are arranged between the adjacent heat exchanging tubes 13, so that air flows as an outside heat exchanging medium between the tubes 13 contact with the fins 14, thereby increasing a heat exchanging efficiency between the refrigerant in the tubes 13 in and the outside air flow. The corrugated fins may advantageously be provided with a plurality of louvers for increasing the heat transmission performance.

The headers 15 and 16 are provided with openings, to which the corresponding ends of the heat exchanging tubes 13 are connected. The first header 15 for reception of incoming refrigerant is provided with a first or top opening **15*a* to which a first inlet conduit 17 is connected and a second or bottom opening 15*b* to which a second inlet conduit 18 is connected. The second header 16 for a discharge of the refrigerant is provided with an outlet opening 16*a* to which an outlet conduit 19** is connected by means of soldering.

A main inlet conduit 20 has an upstream end (not shown in FIG. 4) connected to the compressor 1 in FIG. 1, and a downstream end 21, from which the first and second inlet ducts 17 and 18 are branched. The first inlet conduit 17 is formed with a first section **17*a* directly downstream from the branched portion 21 and formed by bending an aluminum pipe to create a downwardly directed U-shape of a diameter in a range between 10 mm to 30 mm, and a second or upright section 17*b* integrally and vertically extending from the U-shaped sections 17*a*. The upright section 17*b* is, at its top end, connected to the top inlet 15*a* of the first header 15 by means of soldering. The second inlet conduit 18 extends substantially horizontally in a straight manner and is connected to the bottom inlet 15*b***.

The outlet conduit 19 connected to the outlet opening **16*a* is for discharge the refrigerant, condensed to the liquid state when passing through the heat exchanging tubes 13 of condenser 2, into the receiver 3. The diameter of the conduit 19** is in a range between 8 to 25 mm.

The first header 15 is provided therein with partition walls **22*a*, 22*b* and 22*c*, spaced in parallel and extending horizontally in the space inside the header 15, so that first, second, third and fourth inlet chamber sections 15A, 15B, 15C and 15D are created. The second header 16 is provided therein with partition walls 23*a* and 23*b* spaced in parallel and extending horizontally in the space inside the header 16, so that first, second and third outlet chamber sections 16A, 16B and 16C** are created.

The heat exchanging tubes 13 are divided into a first group 24 which is, on one end, connected to the first cheer 15A of the first header 15 and is, on the other end, connected to the first chamber 16A of the second header, a second group 25 which is, one end, connected to the second chamber 15B of the first header 15 and is, on the other end, connected to the first chamber 16A of the second header, a third group 26 which is, one end, connected to the second chamber 15B of the first header 15 and is, on the other end, connected to the second chamber 16B of the second header, a fourth group 27 which is, one end, connected to the third chamber 15C of the first header 15 and is, on the other end, connected to the second chamber 16B of the second header 16, a fifth group 28 which is, one end, connected to the third chamber 15C of the first header 15 and is, on the other end, connected to the third chamber 16C of the second header, and a sixth group 29 which is, on one end, connected to the fourth chamber 15D of the first header 15 and is, on the other end, connected to the third chamber 16C of the second header. As a result, a flow of the refrigerant of a serpentine shape is obtained. Namely, the refrigerant introduced into the first chamber 15A of the first header is, via the heat exchanging tubes 13 of the first group 24, introduced into the first chamber 16A of the second header as shown by arrows $f_1$. The refrigerant in the first chamber 16A is turned back to the second chamber 15B of the first header 15 via the heat exchanging tube 13 of the second group 25 as shown by an arrow $f_2$. The refrigerant in the second chamber 15B is, again, turned back to the second chamber 16B of the second header via the heat exchanging tube 13 of the third group 26 as shown by an arrow $f_3$. The refrigerant introduced into the fourth chamber 15D of the first header 15 is, via the heat exchanging tubes 13 of the sixth group 29, introduced into the third chamber 16C of the second header 16 as shown by an arrow $f_4$. The refrigerant in the third chamber 16C is turned back to the third chamber 15C of the first header 15 via the heat exchanging tube 13 of the fifth group 28 as shown by an arrow $f_5$. The refrigerant in the third chamber 15C is, again, turned back to the second chamber 16B of the second header via the heat exchanging tube 13 of the fourth group 27 as shown by an arrow $f_6$. In such a serpentine flow of the refrigerant, the number of turns of the flow is determined by the numbers of the partition walls **22*a*, 22*b* and 22*c*, and 23*a* and 23*b*. Furthermore, a number of the heat exchanging tubes 13 in each of groups 24 to 29** is determined by the vertical position of the partition walls.

Now, a dehumidifying capacity of the evaporator 5 will be explained. The dehumidifying capacity of the evaporator 5 is expressed by the following equation.

$$Q=G_R\times\Delta_i,$$

where $G_R$ is an amount of the refrigerant passing through the expansion valve 4, and $\Delta_i$ is the enthalpy from the inlet of the evaporator 5 to the outlet of the same. Since the value of $\Delta_i$ is determined by the capacity of the evaporator 5, the dehumidifying capacity Q is determined by the amount $G_R$ of the refrigerant. The amount $G_R$ of the refrigerant is expressed by the following equation.

$$G_R=C\times A\ (P_H-P_L)^{\frac{1}{2}},$$

where C is a constant, A is the area of the opening of the throttle 11 of the expansion valve 4, $P_L$ is the pressure of the refrigerant at the inlet of the evaporator 5, and $P_H$ is the condensing pressure at the condenser 2. The value of $P_L$ is maintained at 2 kgf/cm$^2$ during the winter season since the air conditioning load is small. The value of $P_H$ is varied and is in a range between 3 an 4 kgf/cm$^2$ when the air conditioning load is small, causing the flow amount of the refrigerant to be small, resulting in a reduction of dehumidifying capacity Q. In the case of the multi-flow (MF) condenser 2 as shown in FIG. 4, an increased heat emission capacity is obtained, causing the condensing pressure $P_H$ to be reduced, causing the dehumidifying capacity to be reduced.

In view of the above, the condenser 2 according to the present invention is provided with an improved construction, which can suppress the heat emission at the condenser 2 during the low load condition during the winter season, resulting in an increase in the condensing pressure $P_H$, thereby increasing the flow amount of the refrigerant at the expansion valve 4.

In the Mollier chart in FIG. 3, a curve 102 shows an enthalpy-to-pressure diagram when the load of the refrigerating cycle is high during a summer season. In this case, the temperature and the pressure of the refrigerant at the inlet of the condenser are high, while the amount of the refrigerant is large, causing the speed of the flow of the refrigerant to become high at the inlet conduit 20 in FIG. 1. The refrigerant includes therein a lubricant for the lubrication of parts (not shown) in the compressor (FIG. 1) in sliding engagement with each other. The high speed of the flow of the refrigerant during the high load condition allows the lubricant to be moved upwardly in the upright portion 17*b* together with the flow of the refrigerant, so that the downwardly bent portion 17*a* is prevented from being blocked by the lubricant, which allows the refrigerant to be directed to the condenser 2 via the first inlet conduit 17 as well as the second inlet conduit 18.

The refrigerant introduced into the first chamber 15A of the first header 15 from first inlet pipe 17 flows, via a first "S-shaped" passageway constructed by the group 24 of the heat exchanging tubes 13, the first cheer 16A of the second header 16, the heat exchanging tube group 25, the second chamber 15B of the first header 15, and the heat exchanging tube group 26, into the second chamber 16B of the second header 16. The refrigerant introduced into the fourth chamber 15D of the first header 15 from second inlet pipe 18 flows, via a second "S-shaped" passageway constructed by the group 29 of the heat exchanging tubes 13, the third chamber 16C of the second header 16, the heat exchanging tube group 28, the third chamber 15C of the first header 15, and the heat exchanging tube group 27, into the second chamber 16B of the second header 16. The refrigerant introduced into the cheer 16B via the first and second S-shaped passageways are discharged to the outlet conduit 19 toward the receiver 3. The flows of the refrigerant introduced into the all of the heat exchanging tubes 13 of the heat exchanging portion are thus obtained, which allows the condensing operation to be executed along the entire region of the heat exchanging portion, thereby obtaining the maximum capacity of the condenser 2.

During the winter season, the load is low, so that, in the Mollier chart in FIG. 3, the enthalpy-to-pressure diagram is shown by the curve 100 if the condenser 2 were of the prior art construction, where the temperature and the pressure of the gaseous refrigerant from the compressor 1 are small, on one hand, and the amount of the refrigerant is as small as 50 to 80 liter per hour, causing the speed of the flow of the refrigerant to become low. The slow speed of the refrigerant during the low load condition prevents the lubricant from being moved upwardly in the upright portion 17*b* of the first inlet pipe 17.

Figure 5:
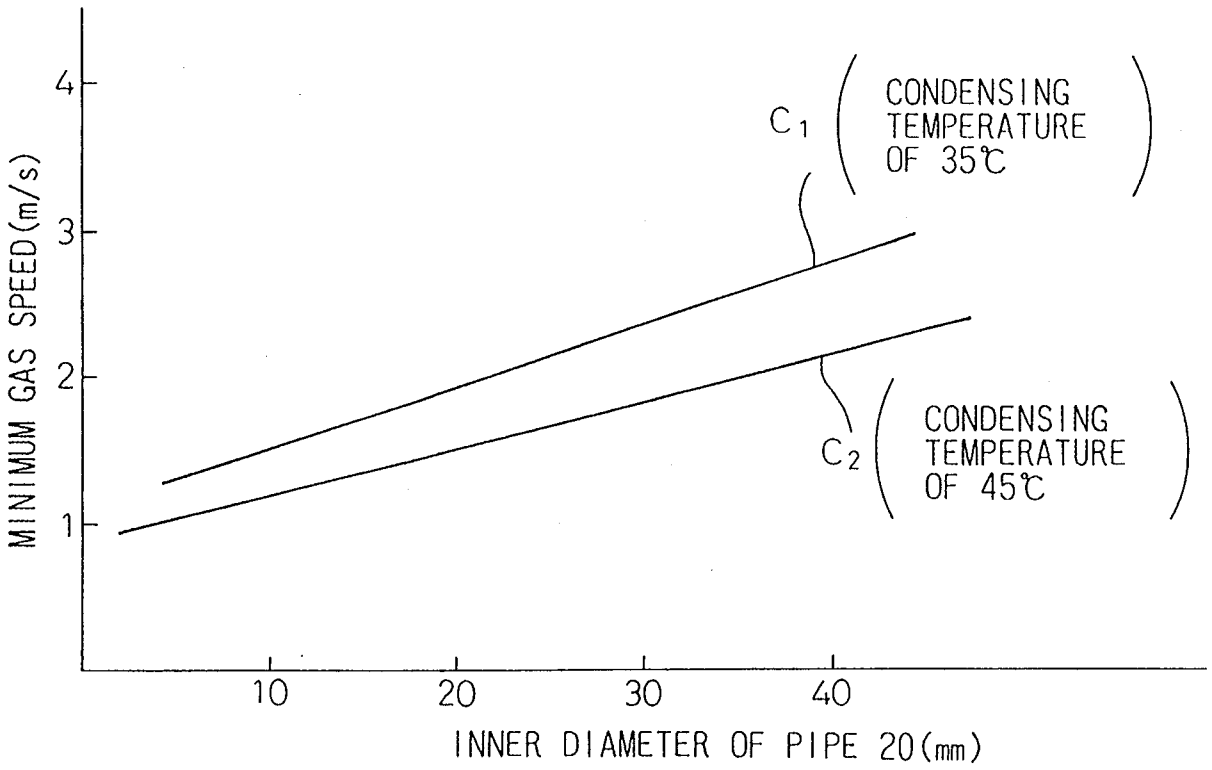
FIG. 5 shows the relationships between the diameter of the inlet conduit and the minimum gas speed.
Figure 6:
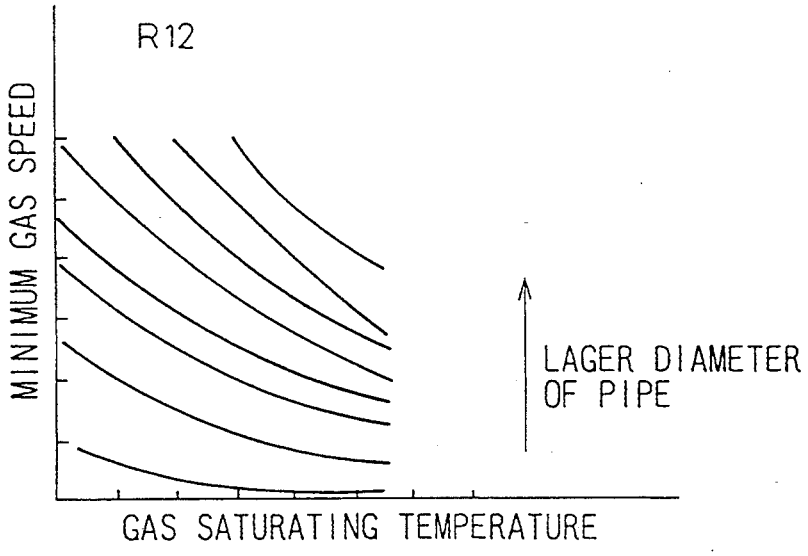
FIG. 6 shows the relationships between the gaseous saturating temperature and the minimum refrigerant gas speed.

Now, an explanation will be given as to a determination of the value of the cross sectional area of the flow passageway of the upright portion 17*a*, which assure that the lubricant mixed in the refrigerant is held at the U-shaped bent portion 17*a* of the first inlet conduit 17 and prevented from being moved upward in the portion 17*a*. FIG. 5 shows the relationship between the diameter of the inlet conduit 20 and the minimum speed of the gas which allows the lubricant to be move upwardly in the upright portion 17*b*. A curve $C_1$ is when the condensing temperature is 35° C., while a curve $C_2$ is when the condensing temperature is 45° C. FIG. 6 shows the relationship between the temperature for saturating the gaseous refrigerant and the minimum gas speed with respect to various values of the diameter of the upright portion 17*b* when R12 is used as the refrigerant.

As is well known, a correspondence exists between the pressure of the refrigerant and the temperature for saturating the gaseous refrigerant. In other words, if a value of the pressure of the refrigerant at the outlet of the compressor 1 during the low load condition in the winter season is given, the temperature for saturating the gaseous refrigerant is automatically determined. Furthermore, the speed of the flow at the upright portion 17*b* is determined as the amount of the flow of the refrigerant divided by the area of the cross section of the flow passageway at the upright portion. As a result, once the flow amount of the refrigerant during the low load state in the winter season is given, the speed of the refrigerant is obtained by determining the cross sectional area of the flow passageway at the upright portion 17*b*. Thus, a determination of the cross-sectional area of the flow passageway of the refrigerant at the upright portion 17*b*, which makes the speed of the refrigerant smaller than the minimum gas speed at the gaseous refrigerant saturating temperature, allows the lubricant to be held at the U-shaped portion 17*a* at the small flow amount of the refrigerant at the low load condition.

A reduction of the speed of the refrigerant, which is enough to makes the lubricant mixed in the refrigerant unable to move upward in the upright portion 17*b* of the first conduit 17, allows the lubricant to be held in the U-shaped portion 17*a* of the conduit 17. As a result, the first conduit is blocked, which prevent the refrigerant from being moved upwardly in the upright portion 17*b*. In other words, the refrigerant cannot flow into the heat exchanging tubes 13 in the groups 24 to 26, corresponding to a heat exchanging area designated by A, which causes the heat emission to be reduced for an amount, which corresponds to the heat emission at the area A, which can be otherwise obtained. As a result, an increase in the temperature of the refrigerant is obtained for the amount corresponding to the reduction of the heat emission at the area A. The increase in the temperature of the refrigerant causes the condensing pressure to be correspondingly increased, due to the fact the temperature of the refrigerant is proportional to the condensing pressure.

In FIG. 3, a curve 101 is an enthalpy-to-pressure diagram during the condensing pressure increase operation according to the present invention. Namely, the increase in the condensing pressure causes the pressure difference $\Delta P_2$ to be increased between the increased condensing pressure at the condenser 2 and the evaporating pressure controlled to a predetermined value at the evaporator 5. As a result, an increase in the pressure difference between the inlet and the outlet of the expansion valve 4 is obtained, resulting in an increase in the flow amount of the refrigerant at the expansion valve, which is enough to obtain a desired evaporating capacity.

According to the test by the inventors, when the condensing pressure is about 4.5 kgf/cm$^2$, an evaporating pressure of about 2 kgf/cm$^2$ can be obtained, which gives a pressure difference of about 2.5 kgf/cm$^2$ between the inlet and the outlet of the evaporator 5, which can provide a desired flow amount of the refrigerant.

Figure 7:
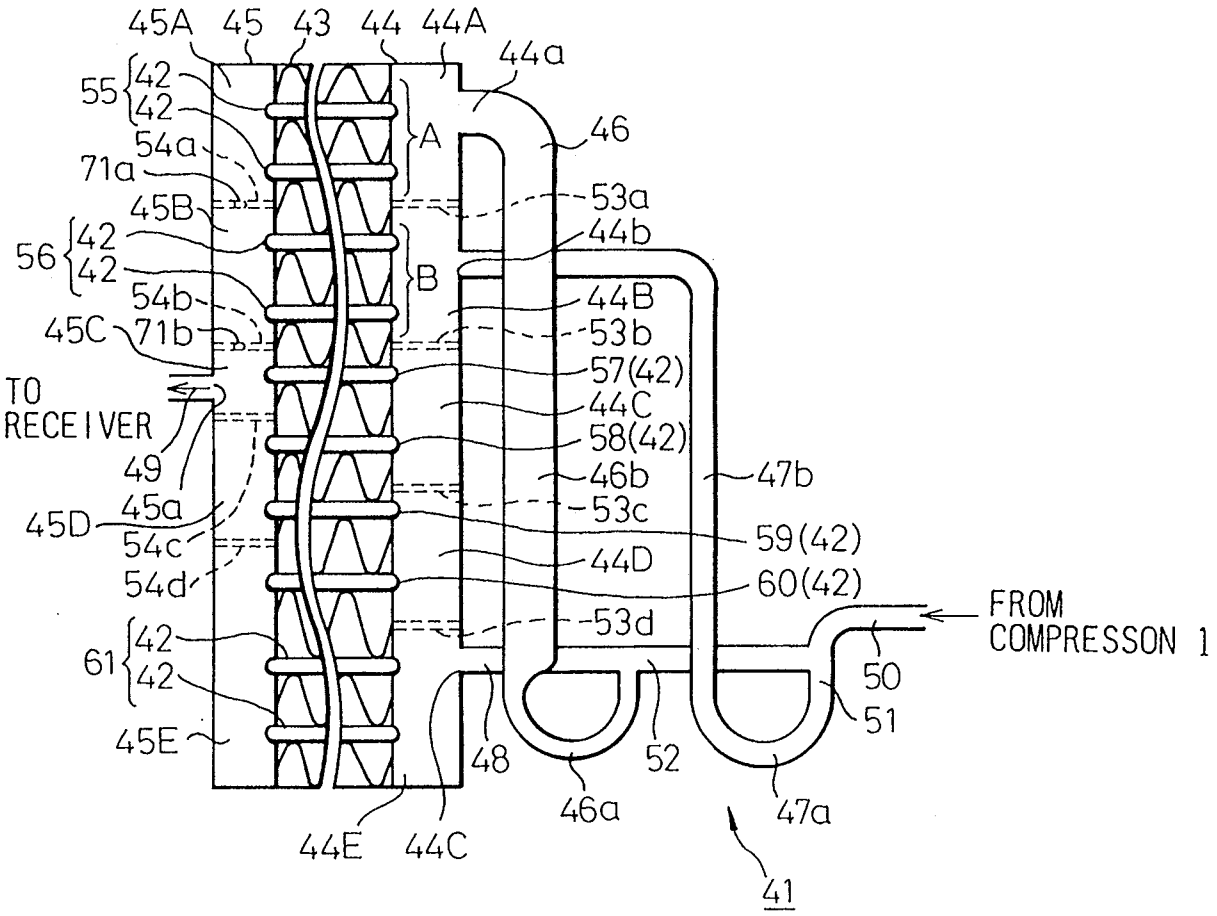
FIG. 7 is similar to FIG. 4, but illustrates a second embodiment.

FIG. 7 shows a second embodiment of the present invention, where a pair of spaced headers 44 and 45 are provided, between which a plurality of heat exchanging tubes 42 are arranged. The first header 44 is provided with a top inlet 44*a* connected to the first inlet conduit 46 for the refrigerant, a middle inlet 44*b* connected to the second inlet conduit 47 for the refrigerant, and a bottom inlet 44*c* connected to the third inlet conduit 48. The second header is provided with an outlet 45*a* connected to the outlet conduit 49 for the refrigerant for discharging the condensed refrigerant in a liquid state toward the receiver 3.

A conduit 50 is located in the refrigerating circuit 1-1 in FIG. 1, and is for receiving the refrigerant from the compressor 1. The second conduit 47 is branched from the conduit 50 at a location 51, while the first conduit 46 is branched from the conduit 50 at a location 53, downstream from the first location 51. The second conduit 47 made of an aluminum material is formed with a downwardly bent portion or an U-shaped portion 47*a* directly downstream from the branch portion 51 and an upright portion 47*b* extending vertically upwardly to the middle inlet 44*b* of the first header Similarly, the first inlet conduit 46 located downstream from the second inlet conduit 47 is formed with a downwardly bent portion or an U-shaped portion 46*a* directly downstream from the branch portion 52 and an upright portion 46*b* extending vertically upwardly to the top inlet 44*a* of the first header 44. As is clearly shown in FIG. 7, the upright portion 46*b* of the first conduit 46 has an inner diameter which is larger than that of the upright portion 47*b* of the second inlet conduit 47. Finally, the first inlet conduit 48 is branched at the location 52 and extends horizontally to the bottom inlet 44*c* of the first header 44.

The first header 44 is provided with partitions 53*a*, 53*b*, 53*c* and 53*d*, which are spaced in parallel, so as to create, from top to bottom, chambers 44A, 44B, 44C, 44D and 44E. The top inlet 44*a* is opened to the chamber 44A, the middle inlet 44*b* is opened to the chamber 44B, and the bottom inlet 44*c* is opened to the chamber 44E.

The second header 45 is provided with partitions 54*a*, 54*b*, 54*c* and 54*d*, which are spaced in parallel, so as to create, from top to bottom, chambers 45A, 45B, 45C, 45D and 45E. The discharge outlet 45*a* is opened to the chamber 45C. The partitions 54*a* and 54*b* are formed with openings 71*a* and 71*b*, respectively for obtaining communications of the chambers 45A with the chamber 45B and of the chamber 45B with the chamber 45C, respectively.

Due to the provision of the partitions 53*a* to 53*d* and 54*a* to 54*d* in the first and second headers 44 and 45, respectively, the heat exchanging tubes 42 are divided into a first group 55 for connection of the chambers 44A and 45A with each other, a second group 56 for connection of the chambers 44B and 45B with each other, a third group 57 for connection of the chambers 44C and 45C with each other, a fourth group 58 for connection of the chambers 44C and 45D with each other, a fifth group 59 for connection of the chambers 44D and 45D with each other, a sixth group 60 for connection of the chambers 44D and 45E with each other, and a seventh group for connection of the chambers 44E and 45E with each other. As a result, the refrigerant introduced into the chamber 44A of the first header 44 via the top inlet 44*a* is introduced, via the heat exchanging tubes 42 of the first group 55, into the chamber 45A of the second header 45. The refrigerant in the chamber 45A is introduced, via the openings 71*a*, into the second chamber 45B. The refrigerant introduced into the chamber 44B of the first header 44 via the middle inlet 44*b* is introduced, via the heat exchanging tubes 42 of the second group 56, into the chamber 45B. The refrigerant introduced into the fifth chamber 44E is introduced, via the heat exchanging tubes 42 of the seventh group 61, into the fifth chamber 45E of the second header 45. The refrigerant in the chamber 45E is introduced, via the heat exchanging tube 42 of the sixth group 60, into the fourth chamber 44D. The refrigerant in the chamber 44D is introduced, via the heat exchanging tube 42 of the fifth group 59, into the fourth chamber 45D. The refrigerant in the chamber 45D is introduced, via the heat exchanging tube 42 of the fourth group 58, into the chamber 44C. The refrigerant in the chamber 44C is introduced, via the heat exchanging tube 42 in the third group 57, into the third chamber 45C of the second header 45. In short, as far as the refrigerant introduced into the bottom chamber 44E from the third inlet conduit 48 is concerned, a serpentine flow of the refrigerant is obtained between the first and second headers 44 and 45. The number of the change in the direction of the movement in the serpentine flow is determined by the numbers of the partitions 53*a* to 53*d*, as well as 54*a* to 54*d*. Furthermore, the number of the heat exchanging pipes in the respective groups is determined by the position of the respective partitions 53*a* to 53*d*, as well as 54*a* to 54*d*.

Now, an operation of the second embodiment in FIG. 7 will be explained.

During a high load operation during the summer season, the temperature and pressure of the refrigerant at the outlet of the condenser 41 are high, while, due to the large amount of the flow of the refrigerant, the speed of the flow at the inlet conduit 50 becomes high. Due to the high speed of the flow at the conduit 50, the flow of the refrigerant is enough to cause the lubricant mixed with the refrigerant to be moved upwardly in the upright portion 46*b* of the first inlet conduit 46 as well as the upright portion 47*b* of the second inlet conduit 47 of the smaller diameter. As a result, both of the U-shaped portions 46*a* and 47*a* are prevented from being blocked by the lubricant. As a result, the refrigerant can flow into the condenser 41 via all of the first, second and third inlet conduits 46, 47 and The refrigerant introduced into the chamber 44A of the header via the first conduit 46 flows, along the order of the chamber 44A, the group 55 of the heat exchanging tubes the chamber 45A, and the chamber 45B, into the chamber 45C. Similarly, the refrigerant introduced into the chamber 44B of the header via the second conduit 47 flows in the order of the chamber 44B, the group 56 of the heat exchanging tubes 42, the chamber 45B, and the chamber 45C. Finally, the refrigerant introduced into the chamber 44E of the header via the third conduit 48 flows, in the order of the chamber 44E, the group 61 of the heat exchanging tubes 42, the chamber 45E, the group 60 of the heat exchanging tube 42, the chamber 45D, the group 59 of the heat exchanging tube 42, the chamber 45D, the group 58 of the heat exchanging tube 42, the chamber 45C, and the group 57 of the heat exchanging tube 42, into the chamber 45B. The refrigerant in the chamber 45C is discharged into the conduit 49 via the outlet opening 45*a*.

In the high load condition, the refrigerant passes through all of the heat exchanging passageways in the condenser 41, which allows the latter to provide the maximum heat exchanging capacity. In this high load condition, the condensing pressure is in a range between 12 and 20 kgf/cm$^2$, while the condensing temperature is about 60° C.

In a medium load condition, where the temperature and the pressure of the gaseous refrigerant (refrigerant) as compressed at the compressor 1 and introduced into the condenser 41 are smaller than those at the high load condition. As a result, the flow amount as well as the speed becomes smaller when compared with those at the high load condition. As will be easily understood from FIGS. 5 and 6, a reduction of the speed of the refrigerant causes it to be, first, reduced to a value smaller than the value of the minimum gas speed at the upright portion of the larger diameter. In other words, the gaseous refrigerant is, first, prevented from being moved upwardly in the upright portion 46*b* of the larger diameter, of the first inlet conduit, which causes the lubricant to fill the U-shaped portion 46*a*, thereby preventing the refrigerant from being introduced into the chamber 44A via the top opening 44*a*. As a result, the refrigerant is prevented from passing the heat exchanging tubes 42 of the first group 55, corresponding to the heat exchanging area A of the condenser 41, causing the heat exchanging capacity to be correspondingly reduced. Such a reduction of the heat exchanging capacity causes the temperature of the refrigerant to be correspondingly increased. Thus, an increase in the condensing pressure corresponding to the increase in the temperature is obtained. In this case, the condensing pressure is about 10 kgf/cm$^2$, and the condensing temperature is about 30° C.

At a low load condition during the winter season, where the temperature and the pressure of the gaseous refrigerant (refrigerant) as compressed at the compressor 1 and introduced into the condenser 41 are further reduced. As a result, the flow amount as well as the speed are further reduced. Such a further reduction of the speed of the refrigerant prevent the lubricant mixed in the refrigerant from being moved upwardly also in the upright portion 47*b* of the smaller diameter, of the second inlet conduit, which causes the lubricant to fill the U-shaped portion 47*a*, thereby preventing the refrigerant from being introduced into the chamber 44B via the middle opening 44*b*. As a result, the refrigerant is also prevented from passing the heat exchanging tubes 42 of the second group 56, corresponding to the heat exchanging area B of the condenser 41, causing the heat exchanging capacity to be further reduced. Such a further reduction of the heat exchanging capacity causes the temperature of the refrigerant to be correspondingly increased. Thus, an increase in the condensing pressure corresponding to the increase in the temperature is obtained. In this case, the condensing pressure is about 4.5 kgf/cm$^2$, and the condensing temperature is in a rage between 15° and 16° C.

In short, in the second embodiment in FIG. 7, the first and second inlet conduits 46 and 47 with the respective U-shaped portions 46*a* and 47*a* are provided, while the diameter is varied between the upright portions 46*b* and 47*b* of the first and second inlet conduits 46 and 47. As a result, the blockage of the flow of the refrigerant occurs when the speed of the refrigerant is reduced to different values between the upright portions 46*a* and 47*b* of the first and second conduits 46 and 47. As a result, a three stage change in the effective heat emission area is obtained in accordance with the change in the load. In other words, a desired heat emission area matched to the load can be obtained. A number of the conduits (46 and 47) with the U-shaped portions (46*a* and 47*a*), their diameter as well as their vertical locations can be suitable adjusted to obtain a desired control.

The above embodiments are directed to the MF (multi-flow) type condenser. However, the present invention can also be applied to the other type of a condenser, such as a serpentine type.

Figure 8:
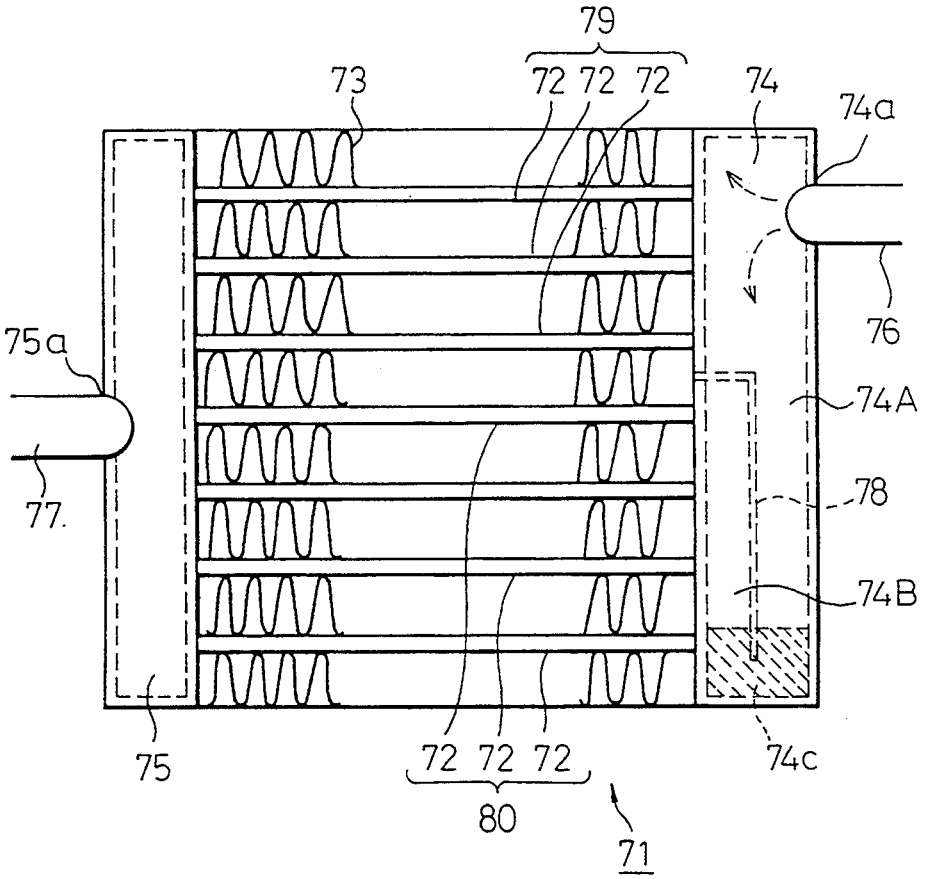
FIG. 8 is also similar to FIG. 4, but illustrates a third embodiment.

FIG. 8 illustrates a third embodiment of the present invention realized as a multi-flow type condenser with an oil trap. Namely, the condenser 71 is provided with a pair of spaced apart headers 74 and 75, between which a heat exchanging device is arranged, which is constructed by a plurality of spaced heat exchanging tubes 72 and corrugated fins 73 arranged between adjacent heat exchanging tubes 72. The inlet header 74 is formed with a top inlet 74*a*, to which an inlet conduit 76 is connected. The outlet header 75 is formed with an outlet 75*a*, to which an outlet pipe 77 is connected by a soldering. Inside the inlet header 74, a partition member 78 of an inverse L-shape is arranged so that the member 78 extends downwardly, while creating a space between the bottom edge of the member 78 and a faced inner wall of the header 74, so that a first and second chambers 74A and 74B, which are in communication at their bottom, are created. The heat exchanging tubes 72 are divided into a first group 79 which is opened to the first cheer 74A and a second group 80 which is opened to the second chamber 74B. The bottom portion of the space inside the first header 74 for connecting the first and second chambers 74A and 74B construct a lubricant reservoir according to the present invention. Furthermore, the second chamber 74B functions as the upright portion 17*b* does in the first embodiment in FIG. 4.

Now, an operation of the third embodiment will be explained.

During a high load condition in the summer season, the temperature and the pressure of the refrigerant at the inlet to the condenser 71 is high, and the flow amount is large, so that the speed of the refrigerant introduced into the inlet header 74 via the conduit 76 is high. The high speed of the refrigerant introduced into the conduit 76 during the high load condition allows the lubricant mixed to the refrigerant to be moved upwardly in the chamber 74B of the header 74. Thus, the bottom portion 74C of the header is not blocked by means of the lubricant. Thus, the refrigerant can be introduced not only into the first group 79 of heat exchanging tubes 72 but also into the second group 80 of the heat exchanging tubes 72. Since a flow of the refrigerant can be obtained in all of the heat exchanging passageways in the condenser 72. In other words, the condensing operation uses all of the area of the heat exchanging unit. Thus, the maximum condensing capacity of the condenser 72 can be obtained.

During a low load condition in the winter season, the temperature and the pressure of the refrigerant at the inlet to the condenser 71 is low, and the flow amount is small, so that the speed of the refrigerant introduced into the inlet header 74 via the conduit 76 is low. The low speed of the refrigerant introduced into the conduit 76 during the low load condition prevents the lubricant mixed to the refrigerant from being moved upwardly in the chamber 74B of the header 74, causing the lubricant to stay at the bottom portion 74C as shown by shaded lines in FIG. 8. Thus, the lubricant at the bottom portion 74C blocks the flow of the refrigerant into the second chamber 74B, i.e., the heat exchanging tubes 72 in the second group 80. In other words, the refrigerant can be introduced only into the first group 79 of heat exchanging tubes 72. Thus, a flows of the refrigerant can be obtained only at the first group 79 heat exchanging pipes. In other words, the condensing operation is done using only a part 79 of the area of the heat exchanging unit. Thus, a reduced capacity of the condenser 72 can be obtained. Due to the reduced condensing capacity at the condenser, the temperature at the condenser 71 is correspondingly increased. The increase in the temperature can cause the condensing pressure to be increased at the condenser 7i. As a result, the pressure difference is increased between this increased condensing pressure and the evaporating pressure at the outlet of the evaporator 5 controlled to the predetermined value by the EPR 6 in FIG. 1. Thus, an increased pressure difference is obtained between the inlet and outlet of the expansion valve 4, thereby increasing a flow amount of the refrigerant into the evaporator, thereby maintaining a desired evaporating capacity. Thus, a desired dehumidifying function during the winter season is obtained, which is effective to quickly clear a fog on the window generated by a heating operation in the inner recirculation mode.

While embodiments are explained with reference to attached drawings, many modification and changes can be made by those skilled in this art, without departing from the scope and sprit of the present invention.

We claim:

1. A condenser for constructing, together with a compressor, a pressure reducing means and an evaporator, a refrigerating cycle, said condenser comprising:

a plurality of vertically spaced heat exchanging tubes in which a refrigerant in the refrigerating cycle flows, while an outer flow of a heat exchanging medium contacts the heat exchanging tubes, so that a heat exchange occurs between the refrigerant in the heat exchanging tubes and the heat exchanging medium, causing the heat to be emitted from the heat exchanging tubes;

an inlet of the gaseous state refrigerant from the compressor into the heat exchanging tubes;

an outlet of the condensed refrigerant from the heat exchanging tubes;

the heat exchanging pipes being grouped into at least two sets, the heat exchanging pipes in the first set defining a first heat exchanging passageway for the refrigerant, the heat exchanging pipes in said second set defining a second heat exchanging passageway for the refrigerant, the flows of the refrigerant in the first and second passageways taking place separate from each other;

a first inlet passageway for connecting said inlet with the first heat exchanging passageway in the first set of the heat exchanging pipes for introducing a part of the introduced gaseous refrigerant into the first heat exchanging passageway;

a second inlet passageway for connecting said inlet with the second heat exchanging passageway in the second set of the heat exchanging pipes for introducing a remaining part of the introduced gaseous refrigerant into the second heat exchanging passageway;

said first inlet passageway forming, at a location along the flow of the refrigerant, a portion for causing a lubricant mixed with the refrigerant to stay at the portion;

said portion being such that the lubricant held at the portion closes the first inlet passageway for blocking the flow of the refrigerant in the first inlet passageway when the amount of the flow of the refrigerant is smaller than a predetermined value, thereby introducing the refrigerant from the compressor only into the second heat exchanging passageway.

2. A condenser according to claim 1, wherein said portion for causing the lubricant to be held is formed as a U-shaped portion extending downwardly, and wherein said first inlet passageway is formed, at a location downstream from the U-shaped portion, an upright portion for introducing the refrigerant into the first heat exchanging passageway.

3. A condenser according to claim 1, wherein the heat exchanging tubes are, in addition to the first and second sets, further grouped to a third set, wherein it further comprises additional inlet passageway for connecting said inlet with the third heat exchanging passageway in the third set of the heat exchanging pipes for introducing the gaseous refrigerant into the third heat exchanging passageway, wherein said additional inlet passageway forms, on a location along the flow of the refrigerant, a portion for causing a lubricant mixed with the refrigerant to be held at the portion, and wherein the formation of the portion in the additional inlet passageway is such that the lubricant held at the portion closes the additional inlet passageway for blocking the flow of the refrigerant in the additional inlet passageway when the amount of the flow of the refrigerant in the additional inlet passageway is smaller than a second predetermined value which is different from the predetermined value which causes the portion in the first inlet passageway to block the flow of the refrigerant in the first inlet passageway.

4. A condenser according to claim 3, wherein these portions in the first and additional passageways for causing the lubricant to be held is formed as a U-shaped portion extending downwardly, and wherein said first and additional passageways form, at respective locations downstream from the U-shaped portions, respective upright portions for introducing the refrigerant into the first and additional passageways, respectively, and wherein the diameter of the upright portions are different from each other.

5. A condenser according to claim 1, wherein it further comprises a box shaped casing member provided therein with a partition wall extending vertically downwardly, so as to create a first chamber as the first passageway opened to the inlet, on one hand, and connected to the first set of the heat exchanging tubes, on the other hand, and a second chamber connected to the first chamber, on one hand, and connected to the second set of the heat exchanging tubes, on the other hand, the partition being spaced from an opposite bottom wall of the casing so as to form a gap for connecting the first and second chambers with each other and for creating said portion for causing the lubricant to be held.

6. A condenser for constructing, together with a compressor, a pressure reducing means and an evaporator, a refrigerating cycle, said condenser comprising:

a plurality of vertically spaced heat exchanging tubes in which a refrigerant in the refrigerating cycle flows, while an outer flow of a heat exchanging medium contacts with the heat exchanging tubes, so that a heat exchange occurs between the refrigerant in the heat exchanging tubes and the heat exchanging medium, causing the heat to be emitted from the heat exchanging tubes;

a header connected to the heat exchanging tubes for introducing the refrigerant into the heat exchanging tubes;

partitions in the header for grouping the heat exchanging pipes into a first and second sets, so that the heat exchanging pipes in the first set define a first heat exchanging passageway for the refrigerant, while the heat exchanging pipes in said second set define a second heat exchanging passageway for the refrigerant, the flows of the refrigerant in the first and second passageways taking place separate from each other;

a first inlet conduit for introducing the gaseous state refrigerant from the compressor into the first heat exchanging passageway, and a second inlet conduit for introducing the gaseous state refrigerant from the compressor into the second heat exchanging passageway, the first inlet being located at a higher location than the second inlet;

an outlet for removal of the condensed refrigerant from the heat exchanging tubes in the first and second sets;

said first inlet conduit having a U-shaped bent portion extending downwardly, and a upright and straight portion extending vertically from the U-shaped portion to said first inlet at the header;

said second inlet conduit extending substantially horizontally and connected to the second inlet of the header, and;

an introduction conduit connected to the compressor having one end for receiving the gaseous refrigerant of a high pressure and temperature from the compressor and a second end connected to the first and second inlet conduits.

7. A condenser for constructing, together with a compressor, a pressure reducing means and an evaporator, a refrigerating cycle, said condenser comprising:

a plurality of vertically spaced heat exchanging tubes in which a refrigerant in the refrigerating cycle flows, while an outer flow of a heat exchanging medium contacts the heat exchanging tubes, so that a heat exchange occurs between the refrigerant in the heat exchanging tubes and the heat exchanging medium, causing the heat to be emitted from the heat exchanging tubes;

a header connected to the exchanging tubes for introducing the refrigerant into the heat exchanging tubes;

an outlet for removal of the condensed refrigerant from the heat exchanging tubes, and;

a partition extending substantially vertically for grouping the heat exchanging pipes into a first and second sets, while a gap is created between an end of the partition and a faced inner wall of the header, so that first and second chambers, connected with each other via said gap at the bottom, are created in the header and so that the heat exchanging pipes are grouped into a first and second sets, the heat exchanging pipes in the first set define, together with the first chamber, a first heat exchanging passageway for the refrigerant, while the heat exchanging pipes in said second set define, together with the second chamber, a second heat exchanging passageway for the refrigerant, the flows of the refrigerant in the first and second passageways taking place separate from each other;

a lubricant mixed with the refrigerant being held at the bottom of the header, which causes said gap to be filled thereby, causing the first and second chambers to be disconnected from each other, thereby preventing the refrigerant from being introduced into the second chamber, causing the refrigerant to be introduced only into the first set of the heat exchanging tubes from the first chamber.

* * * * *